US009927109B2

(12) United States Patent
Hsieh

(10) Patent No.: US 9,927,109 B2
(45) Date of Patent: Mar. 27, 2018

(54) TOUCH LAMP

(71) Applicant: HABITEX CORPORATION, Taipei (TW)

(72) Inventor: Pei-Lin Hsieh, Taipei (TW)

(73) Assignee: HABITEX CORPORATION, Taipei (TW)

( * ) Notice: Subject to any disclaimer, the term of this patent is extended or adjusted under 35 U.S.C. 154(b) by 0 days.

(21) Appl. No.: 15/200,552

(22) Filed: Jul. 1, 2016

(65) Prior Publication Data

US 2018/0003371 A1 Jan. 4, 2018

(51) Int. Cl.

| | |
|---|---|
| ***F21V 23/04*** | (2006.01) |
| ***F21V 23/00*** | (2015.01) |
| ***F21S 6/00*** | (2006.01) |
| ***F21V 1/00*** | (2006.01) |
| *F21Y 115/10* | (2016.01) |

(52) U.S. Cl.

CPC ..... *F21V 23/0485* (2013.01); *F21S 6/005* (2013.01); *F21V 1/00* (2013.01); *F21V 23/002* (2013.01); *F21V 23/003* (2013.01); *F21Y 2115/10* (2016.08)

(58) Field of Classification Search

CPC ..... F21Y 2115/10; F21Y 2101/00; F21Y 2113/00; F21Y 2113/10; F21Y 2113/13; F21Y 2115/30; F21V 23/04; F21V 23/0485; F21V 23/0492; F21V 23/0471; F21V 33/0024

USPC ..... 362/394

See application file for complete search history.

(56) References Cited

U.S. PATENT DOCUMENTS

| | | | | |
|---|---|---|---|---|
| 4,507,716 | A * | 3/1985 | Benedict, Jr. | F21S 6/002 362/295 |
| 6,027,343 | A * | 2/2000 | Ho | G09B 27/08 362/809 |
| 6,053,798 | A * | 4/2000 | Tang | A47G 33/06 446/300 |
| 6,183,257 | B1 * | 2/2001 | Ho | G09B 27/08 362/809 |
| 2005/0207141 | A1 * | 9/2005 | Boesch | A47G 19/2227 362/101 |
| 2006/0181887 | A1 * | 8/2006 | Chen | F21S 6/008 362/395 |
| 2007/0159834 | A1 * | 7/2007 | Chen | F21S 6/008 362/395 |
| 2010/0014291 | A1 * | 1/2010 | Ben Natan | F21S 11/00 362/277 |

* cited by examiner

*Primary Examiner* — Thien M Le

(74) *Attorney, Agent, or Firm* — Hamre, Schumann, Mueller & Larson, P.C.

(57) ABSTRACT

A touch lamp includes a touch unit configured to be touched by a user for generating a touch signal, a support frame, a base, a light-emitting element and a control unit. The support frame includes upper and lower support members respectively connected to upper and lower sides of the touch unit. The base is connected to a bottom end of the lower support member. The light-emitting element is connected to a top end of the upper support member. The control unit is electrically connected to the touch unit and the light-emitting element. The control unit controls illumination of the light-emitting element according to the touch signal received from the touch unit.

8 Claims, 6 Drawing Sheets

TOUCH LAMP

FIELD

The disclosure relates to a lamp, more particularly to a touch lamp.

BACKGROUND

Usually, a mechanical switch is used to turn on or off a lamp. This kind of mechanical switch has many advantages, such as low power consumption, low cost of production, etc. However, it is susceptible to wear and damage in the course of long term use. To prolong the service life of a switch, a touch type switch is used. A user only has to touch the switch with his/her hand to operate the lamp.

An existing lamp includes a base, a light-emitting element, and a support frame in the form of a hollow rod having two ends respectively connected to the base and the light-emitting element. The support frame further has a surrounding wall with a mounting hole. The lamp further includes a touch switch inserted into the mounting hole. The support frame and the base are not integrally formed, but must be assembled to each other. The touch switch has a round shape and a small area. However, during assembly, care must be taken to ensure that the touch switch faces a user, else the user cannot find the switch.

SUMMARY

Therefore, an object of the present disclosure is to provide a touch lamp that is capable of overcoming the aforesaid drawback of the prior art.

Accordingly, a touch lamp of this disclosure comprises a touch unit configured to be touched by a user for generating a touch signal, a support unit, a light-emitting element and a control unit. The support unit includes a support frame and a base. The support frame includes an upper support member and a lower support member respectively connected to upper and lower sides of the touch unit. The base is connected to a bottom end of the lower support member. The light-emitting element is connected to a top end of the upper support member. The control unit is disposed in the support unit and is electrically connected to the touch unit and the light-emitting element. The control unit controls illumination of the light-emitting element according to the touch signal received from the touch unit.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
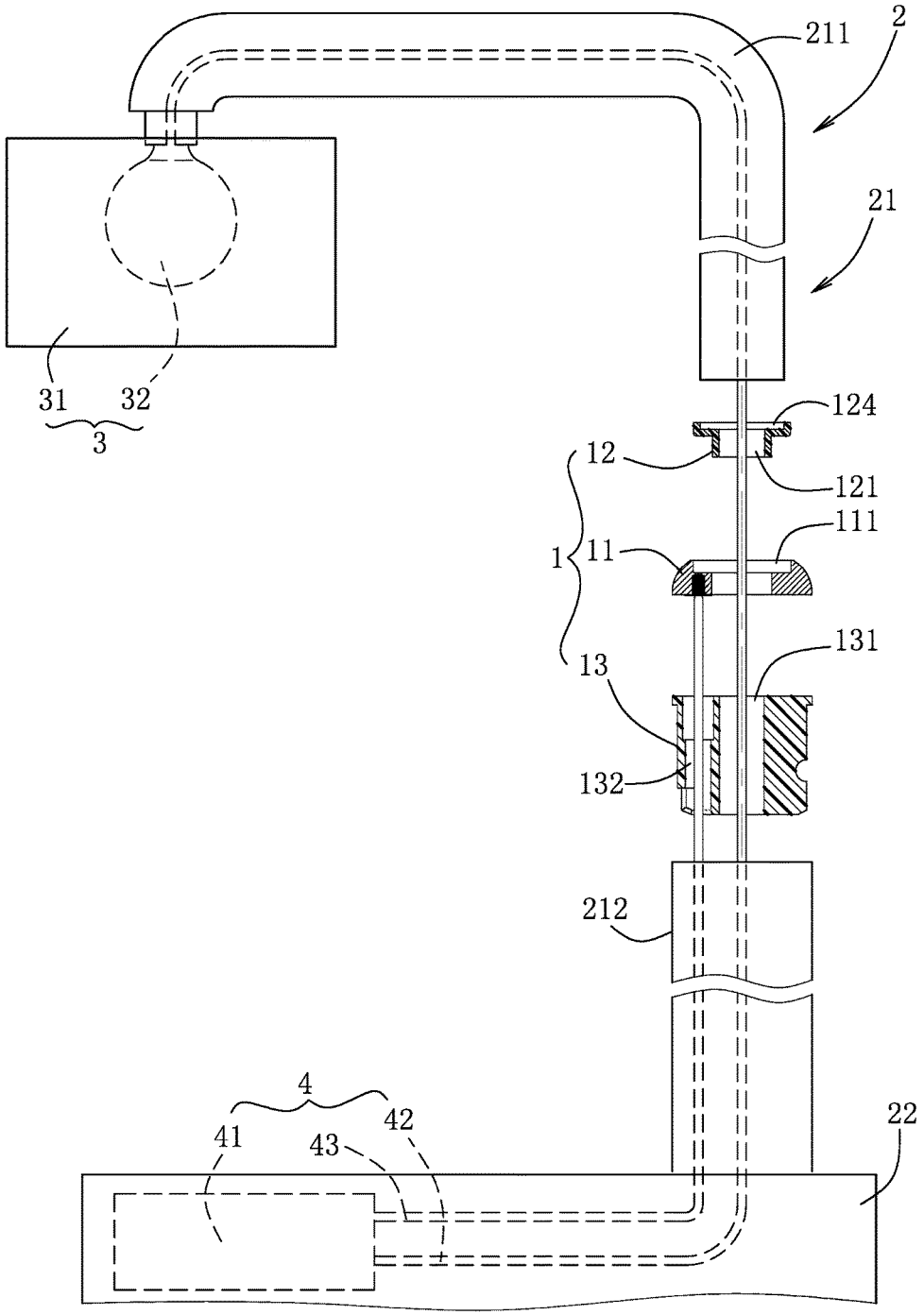
FIG. 1 is an exploded view of a touch lamp according to the embodiment of the present disclosure.
Figure 2:
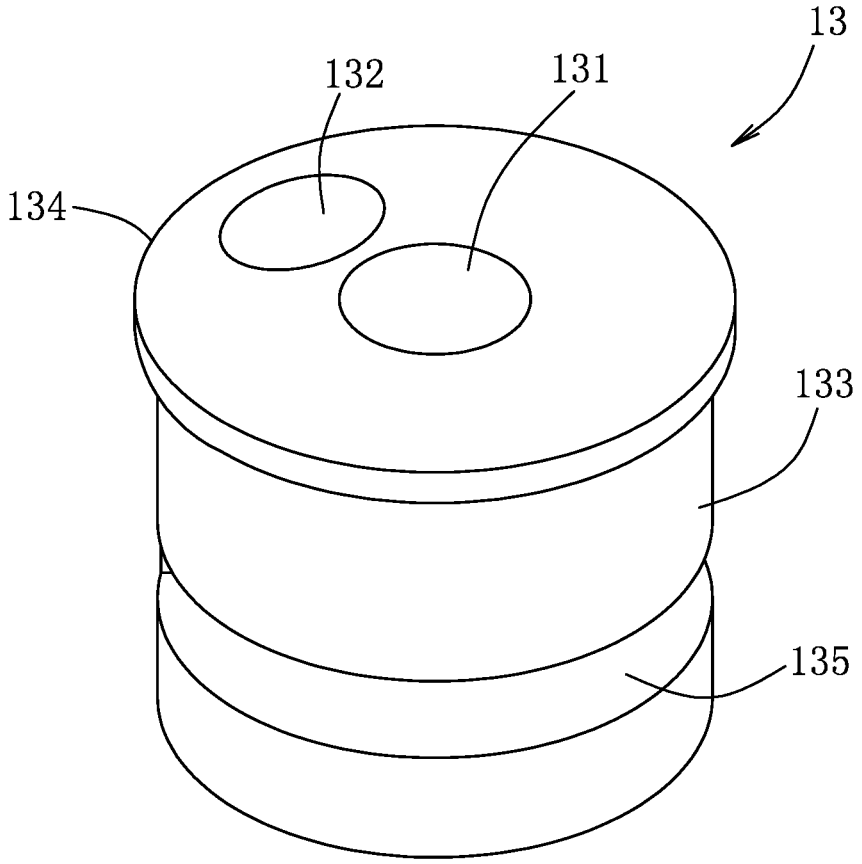
FIG. 2 is a perspective view of a lower insulating member of a touch unit of the embodiment.
Figure 3:
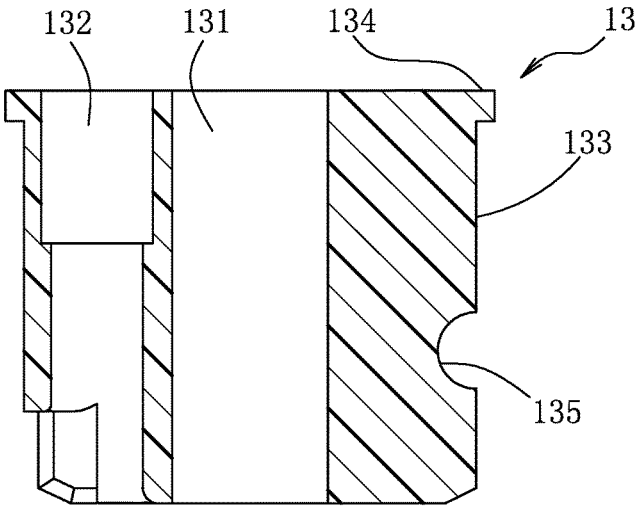
FIG. 3 is a sectional view of the lower insulating member of the embodiment.

Referring to FIGS. 1 to 10, a touch lamp according to the embodiment of the present disclosure is shown to include a touch unit 1, a support unit 2, a lighting unit 3, and a control unit 4 disposed in the support unit 2.

The support unit 2 includes a base 22 and a support frame 21 mounted on the base 22. The support frame 21 is a hollow metal rod, and includes an upper support member 211 and a lower support member 212. An upper side and a lower side of the touch unit 1 are respectively connected to the upper and lower support members 211, 212. A bottom end of the lower support member 212 is connected to the base 22. The upper support member 211 has a lower end connected to the touch unit 1, and an upper end connected to the lighting unit 3. The lighting unit 3 includes a lampshade 31 and a light-emitting element 32 covered by the lampshade 31. The light-emitting element 32 may be an incandescent bulb or a light-emitting diode bulb.

The touch unit 1 includes a metal member 11 electrically connected to the control unit 4 and configured to be touched by a user for generating a touch signal, an upper insulating member 12 disposed between the metal member 11 and the upper support member 211 to insulate the metal member 11 from the upper support member 211, and a lower insulating member 13 disposed between the metal member 11 and the lower support member 212 to insulate the metal member 11 from the lower support member 212.

The lower insulating member 13 has a cylindrical insulating body 133 inserted into a top end portion of the lower support member 212, and an annular flange 134 extending radially, outwardly and integrally from an outer periphery of a top surface of the insulating body 133 and abutting against a top periphery of the lower support member 212. Through this, the lower insulating member 13 can cover the top end portion of the lower support member 212. The lower insulating member 13 further has a first lower through hole 131 extending through the top and bottom surfaces of the insulating body 133 at the center thereof, and a second lower through hole 132 extending through the top and bottom surfaces of the insulating body 133 and radially spaced apart from the first lower through hole 131. The insulating body 133 has an outer circumferential surface formed with a limiting groove 135 extending inwardly therefrom.

Figure 4:
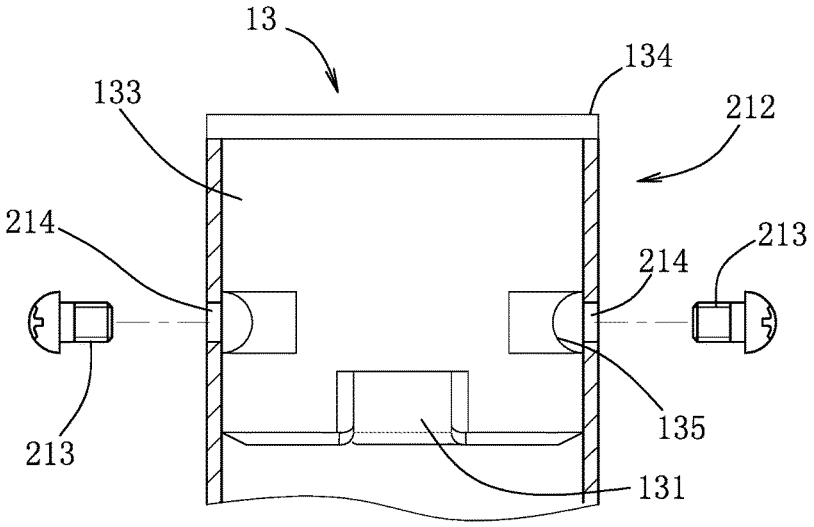
FIG. 4 is a fragmentary assembled sectional view of the embodiment, illustrating how the lower insulating member can be fixed to a lower support member of a support frame.
Figure 5:
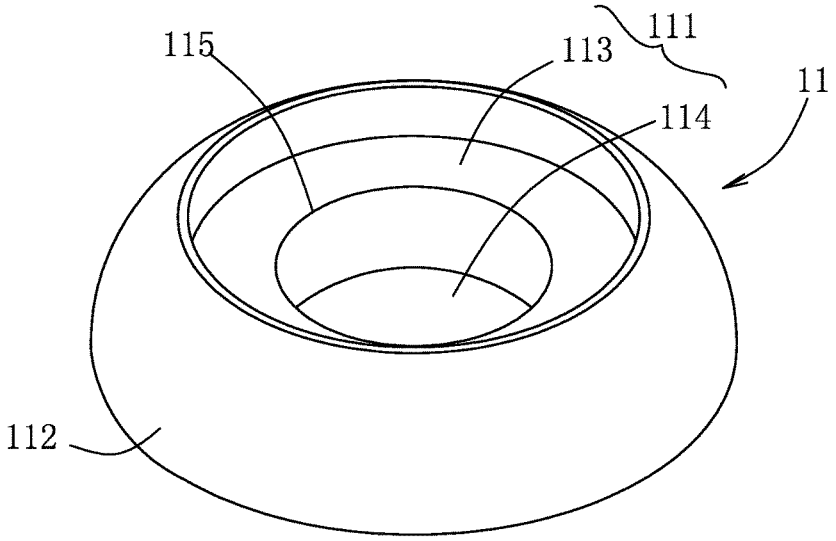
FIG. 5 is a perspective view of a metal member of the touch unit of the embodiment.

With reference to FIG. 4, the lower support member 212 has two fixing members 213, and two spaced-apart fixing holes 214 for extension of the respective fixing members 213 therethrough. When the insulating body 133 is inserted into the lower support member 212 and the limiting groove 135 is registered with the fixing holes 214, the fixing members 213 are inserted through the respective fixing holes 214 into the limiting groove 135 to position the lower insulating member 13 on the lower support member 212. Through this, the lower insulating member 13 is fixed to the lower support member 212. In this embodiment, the lower support member 212 has two fixing holes 214, but may have only one fixing hole. The effect of fixing the lower insulating member 13 to the lower support member 212 may be similarly achieved.

With reference to FIGS. 5 to 8, the metal member 11 of the touch unit 1 has a generally flat circular shape, and has a surrounding wall 112 defining a central through hole 111. The metal member 11 is disposed on the top surface of the insulating body 133, and the central through hole 111 thereof communicates with the first lower through hole 131. The central through hole 111 has a large-diameter hole portion 113 proximate to the upper insulating member 12, a small-diameter hole portion 114 located below and communicating with the large-diameter hole portion 113, and a shoulder portion 115 between the large-diameter hole portion 113 and the small-diameter hole portion 114. The touch unit 1 further includes an engaging member 116. The metal member 11 further has an engaging hole 117 formed in a bottom portion of the surrounding wall 112 for engagement with the engaging member 116.

Figure 6:
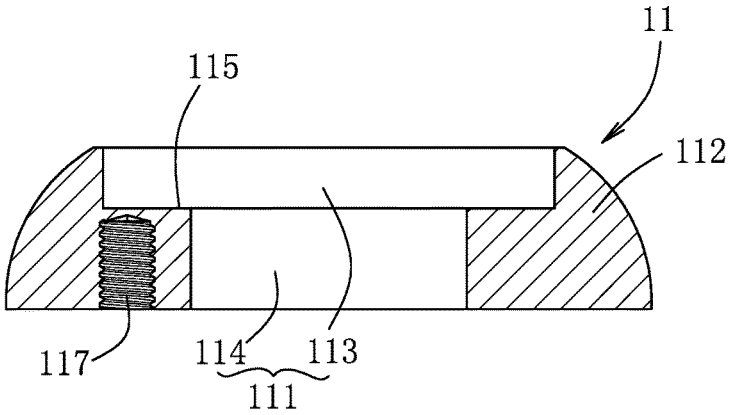
FIG. 6 is a sectional view of the metal member of the embodiment.
Figure 7:
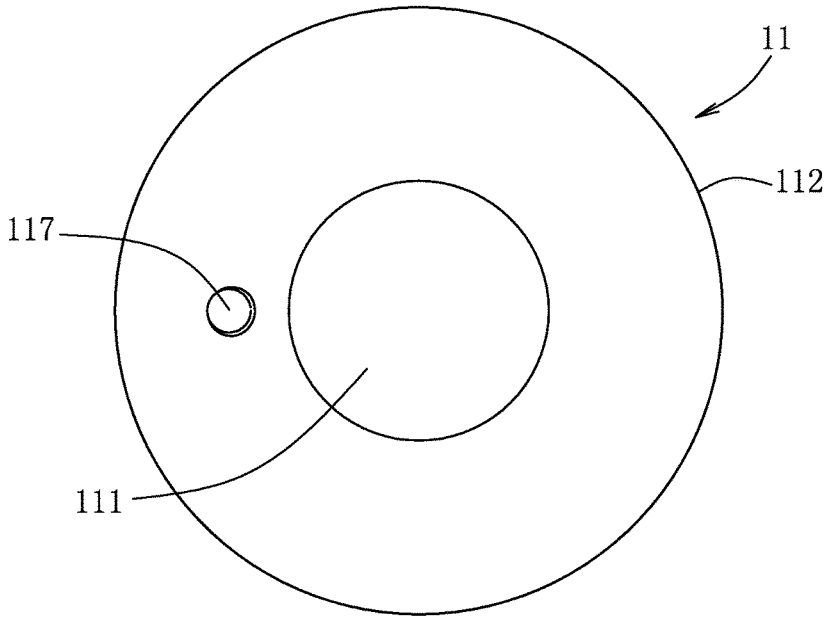
FIG. 7 is a bottom view of the metal member of the embodiment.
Figure 8:
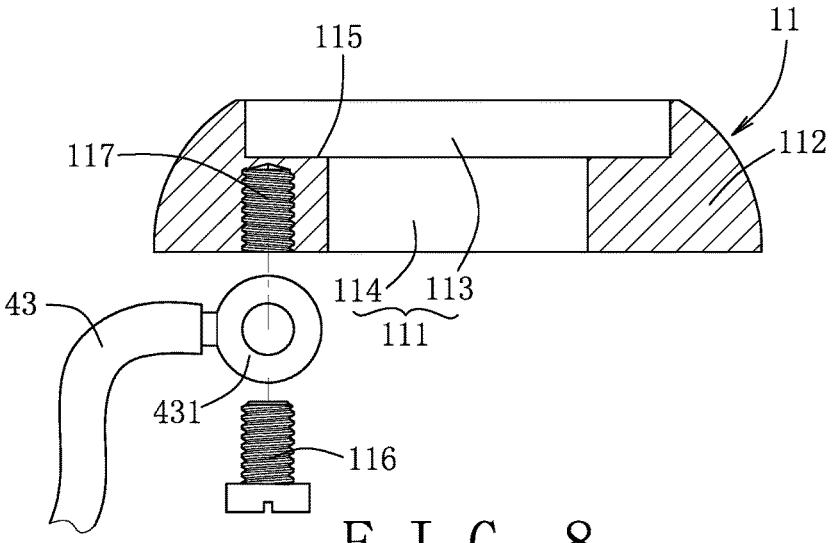
FIG. 8 is a sectional view, illustrating how a second conducting wire can be fixed to the metal member.
Figure 9:
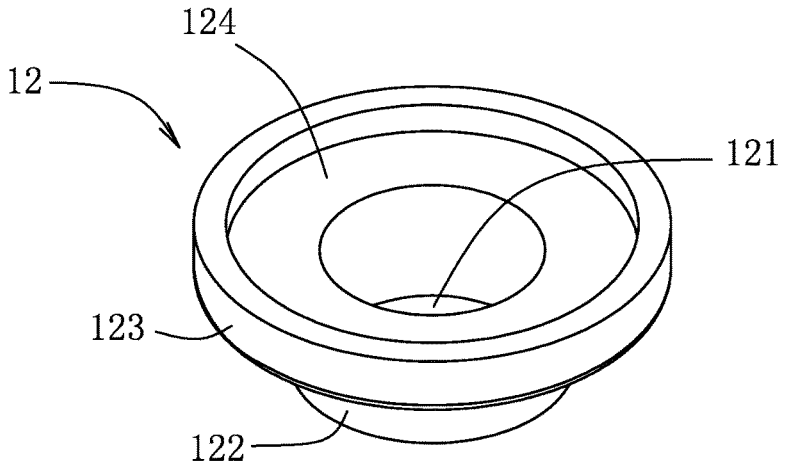
FIG. 9 is a perspective view of an upper insulating member of the touch unit of the embodiment.
Figure 10:
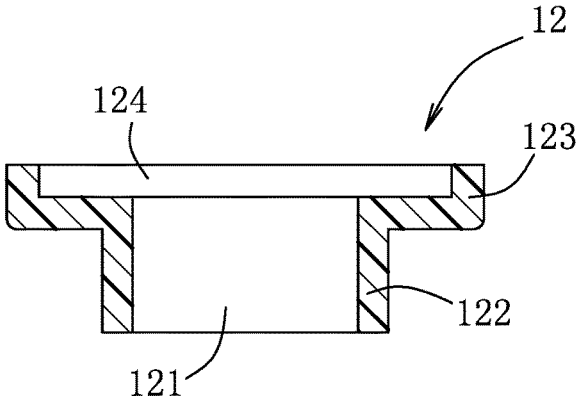
FIG. 10 is a sectional view of the upper insulating member of the embodiment.

With reference to FIGS. 6, 9 and 10, the upper insulating member 12 of the touch unit 1 is disposed in the central through hole 111, and includes a tubular portion 122 defining an upper through hole 121, and a receiving portion 123 extending radially and outwardly from a top periphery of the tubular portion 122 and defining a receiving groove 124 that communicates with the upper through hole 121.

During assembly, the tubular portion 122 is inserted into the small-diameter hole portion 114 of the metal member 11, while the receiving portion 123 is received in the large-diameter hole portion 114 and abuts against the shoulder portion 115 of the metal member 11. The lower end of the upper support member 211 is inserted into the receiving groove 124 of the receiving portion 123. Specifically, an externally threaded hollow rod (not shown), which is fixed to the lower end of the upper support member 211, extends through the upper through hole 121 and the first lower through hole 131, and a nut (not shown) is threadedly engaged to the externally threaded hollow rod to fix the upper support member 211 to the touch unit 1.

As shown in FIG. 1, the control unit 4 is disposed in the base 22 of the support unit 2, and includes a control circuit board 41, a first conducting wire 42 electrically connected to the control circuit board 41 and the light-emitting element 32, and a second conducting wire 43 electrically connected to the control circuit board 41 and the metal member 11. The second conducting wire 43 extends from the control circuit board 41 through the lower support member 212 and the second lower through hole 132 in the lower insulating member 13, and electrically engages the metal member 11.

With reference to FIGS. 1, 3, 8 and 10, the second conducting wire 43 has a terminal ring 431. The engaging member 116 extends through the terminal ring 431, and engages the engaging hole 117 to fix the second conducting wire 42 to the bottom portion of the metal member 11, thereby electrically connecting the metal member 11 and the first conducting wire 42. The first conducting wire 42 extends from the control circuit board 41 through the lower support member 212, the first lower through hole 131 of the lower insulating member 13, the upper through hole 121 and the receiving groove 124 of the upper insulating member 12, and the upper support member 211, and electrically connects with the light-emitting element 32. An outer surface of the surrounding wall 112 of the metal member 11 is configured to be touched by the user to generate a touch signal, which is transmitted to the control circuit board 41 through the second conducting wire 43. The control circuit board 41 then transmits a turn-on or a turn-off signal to the lighting unit 2 through the first conducting wire 42 so as to turn on or off the light-emitting element 32.

In this embodiment, the support frame 21 is made of metal, but is not limited thereto. In other embodiment, the support frame 21 may be made of an insulating material, in which case, the upper and lower insulating members 12, 13 may be omitted.

In sum, because the metal member 11 of the touch unit 1 of this disclosure has a flat circular shape and is sandwiched between the upper and lower support members 211, 212, during assembly, there is no need to consider whether the touch unit 1 is facing the user or not. Hence, the assembly of the touch lamp of this disclosure is very convenient. Therefore, the object of this disclosure can be realized.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the most practical embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A touch lamp comprising:

a touch unit configured to be touched by a user for generating a touch signal;

a support unit including a support frame and a base, said support frame including an upper support member and a lower support member respectively connected to upper and lower sides of said touch unit, said base being connected to a bottom end of said lower support member;

a light-emitting element connected to an upper end of said upper support member; and a control unit disposed in said support unit and electrically connected to said touch unit and said light-emitting element, said control unit controlling illumination of said light-emitting element according to the touch signal received from said touch unit, wherein said support frame is made of a metal material, said touch unit including a metal member electrically connected to said control unit and configured to generate the touch signal, an upper insulating member disposed between said metal member and said upper support member to insulate said metal member from said upper support member, and a lower insulating member disposed between said metal member and said lower support member to insulate said metal member from said lower support member.

2. The touch lamp as claimed in claim 1, wherein said control unit is disposed in said base of said support unit, and includes a first conducting wire electrically connected to said light-emitting element, and a second conducting wire electrically connected to said metal member, said lower insulating member being formed with a first lower through hole for extension of said first conducting wire therethrough, and a second lower through hole radially spaced apart from said first lower through hole for extension of said second conducting wire therethrough, said metal member being formed with a central through hole communicating with said first lower through hole for extension of said first conducting wire therethrough, said upper insulating member being formed with an upper through hole communicating with said central through hole for extension of said first conducting wire there-through.

3. The touch lamp as claimed in claim 2, wherein said metal member has a generally flat circular shape and has a surrounding wall defining said central through hole, said metal member being disposed on a top surface of said lower insulating member, said second conducting wire extending through said second lower through hole and being electrically connected to said surrounding wall, an outer surface of said surrounding wall being configured to be touched by the user for generating the touch signal.

4. The touch lamp as claimed in claim 3, wherein said second conducting wire has a terminal ring, said touch unit further including an engaging member, said metal member further having an engaging hole formed in a bottom portion of said surrounding wall, said engaging member extending through said terminal ring and being engaged to said engaging hole to fix said second conducting wire to said metal member.

5. The touch lamp as claimed in claim 4, wherein said central through hole of said metal member has a large-diameter hole portion, a small-diameter hole portion located below and communicating with said large-diameter hole portion, and a shoulder portion between said large-diameter hole portion and said small-diameter hole portion.

6. The touch lamp as claimed in claim 5, wherein said upper insulating member is received in said central through hole, and includes a tubular portion inserted into said small-diameter hole portion and defining said upper through hole, and a receiving portion extending radially and outwardly from a top periphery of said tubular portion and defining a receiving groove that communicates with said upper through hole, said receiving portion being received in said large-diameter hole portion and abutting against said shoulder portion, a lower end of said upper support member, which is opposite to said upper end thereof, being received in said receiving groove.

7. The touch lamp as claimed in claim 2, wherein said lower support member is configured as a hollow rod, said lower insulating member of said touch unit including a cylindrical insulating body inserted into said lower support member and having top and bottom surfaces, and an annular flange extending radially and outwardly from an outer periphery of a top surface of said insulating body and abutting against a top periphery of said lower support member, said first and second lower through holes extending through said top and bottom surfaces of said insulating body.

8. The touch lamp as claimed in claim 7, wherein said lower support member has at least one fixing member, and at least one fixing hole for extension of said at least one fixing member therethrough, said insulating body having an outer circumferential surface formed with a limiting groove that extends inwardly therefrom, and wherein, when said lower insulating body is inserted into said lower support member and said limiting groove is registered with said at least one fixing hole, said at least one fixing member is inserted through said at least one fixing hole into said limiting groove to position said lower insulating member on said lower support member.

* * * * *